US011565162B1

(12) United States Patent
Karimi

(10) Patent No.: US 11,565,162 B1
(45) Date of Patent: Jan. 31, 2023

(54) GOLF PUTTING SWING TRAINING AID

(71) Applicant: Omeed Karimi, Centreville, VA (US)

(72) Inventor: Omeed Karimi, Centreville, VA (US)

( * ) Notice: Subject to any disclaimer, the term of this patent is extended or adjusted under 35 U.S.C. 154(b) by 0 days.

(21) Appl. No.: 17/409,590

(22) Filed: Aug. 23, 2021

(51) Int. Cl.
*A63B 69/36* (2006.01)

(52) U.S. Cl.
CPC .... *A63B 69/3685* (2013.01); *A63B 2225/093* (2013.01)

(58) Field of Classification Search
CPC ..... A63B 69/3685; A63B 2225/093
USPC ..... 473/206, 212, 213, 214, 227, 257, 276, 473/219, 226
See application file for complete search history.

(56) References Cited

U.S. PATENT DOCUMENTS 5,248,146 A * 9/1993 Viets ..... A63B 69/0059 473/212
5,259,621 A * 11/1993 Keefer ..... A63B 69/0059 473/227
5,649,870 A * 7/1997 Harrison ..... A63B 53/007 473/239
5,904,624 A * 5/1999 Martinez ..... A63B 69/3676 273/DIG. 30
7,033,282 B1 * 4/2006 Flood ..... A63B 69/0059 473/226
7,033,284 B2 * 4/2006 Yoshimura ..... A63B 69/0059 473/227
8,556,741 B2 * 10/2013 Ryan ..... A63B 69/3623 473/238

* cited by examiner

*Primary Examiner* — Nini F Legesse

(57) ABSTRACT

A golf putting swing training aid that may be attached to any golf club that may force a golfer's hands into the proper grip position for various types of golf putting shots is provided. The device and methods of the present disclosure may further allow a golfer to practice these shots to build muscle memory and to ingrain the proper grip and form positions into memory to allow for repeated and consistent shot performance.

3 Claims, 9 Drawing Sheets

GOLF PUTTING SWING TRAINING AID

BACKGROUND OF THE INVENTION

Golf is a sport enjoyed by people with a wide range of skill levels from those amateur weekend players to professionals. Every year those same players spend millions of dollars on golf equipment, lessons, and training aids all with the aim of improving their scores by increasing their precision, accuracy, and power of every swing taken.

The arm and hand posture on a golf putting club is one of the primary factors that determines how well a golfer plays golf and for that reason considerable time and money is invested by golfers to improve their strokes and in particular for this aid, the putting stroke. Putting is when the golf ball is close to the hole and the golfer uses their skill to hit the golf ball softly but with enough power and in the right trajectory with a putting club to get the ball into the hole. A golfer hitting the golf ball with a fundamentally sound golf putting swing can ensure that the ball is hit with power, precision, and accuracy more consistently. In a fundamentally sound golf putting swing, the golf club in relation to the body can be in positions at appropriate times or in the proper sequence during the golf putting swing to help the golfer hit the ball more efficiently. When done properly, the golf swing can look fluid and natural.

Getting into fundamentally sound positions during the golf putting swing can often feel awkward and hard to come by and even unnatural for the average amateur weekend golfer. The average golfer may proceed to swing in a way that is comfortable for them, but fundamentally less than ideal, and hit the ball poorly because of it. This can lead to frustration and bad scores, which can be avoided through the improvement of the golf putting swing.

Golf instruction can be based on the golfer learning by feel and their own intuition. In this method, the golfer instinctively feels the proper way to swing the golf club rather than being told the proper, generic, and standardized body and golf club positions or what the proper swing should look like. In one approach, some instructors ask golfers to place their hands on the golf club where it feels comfortable for them and to then generate the putting swing force in whatever way is comfortable for them and to then hold a position in their golf putting swing (such as the top of the strong arc stroke), then modify to whereby the hand position on the club is correct and to lock the wrists so that the swing force is generated by the large left and right deltoid muscles so the golfer can feel the difference between the fundamentally unsound motion and hand position versus a fundamentally sound hand position motion arising from the use of the deltoid muscles. This approach does not allow the golfer to hit the golf ball in one fluid motion. So, although the golfer gets the feeling of what the correct motion is, the golfer does not necessarily know what that motion feels like during the fluid and constantly moving golf putting swing.

A golfer can experience any number of problems during the golf putting swing, such as a series of flaws during the golf putting swing or one flaw leading to another.

BRIEF SUMMARY OF THE INVENTION

The present disclosure addresses these and other issues by providing a golf putting swing training aid that may be attached to any golf club that does not have a counterbalance in the grip and may force a golfer's hands into the proper grip position for various types of golf putting shots and to prevent the use of the wrists to generate the swing force. The device and methods of the present disclosure may further allow a golfer to practice these shots to build muscle memory and to ingrain the proper grip positions and swing motion into memory to allow for a repeatable and consistent shot performance.

Methods and apparatus of a golf putting swing training aid include a curved plastic arm support that when in contact with the body serves to limit the movement of the wrists and to create the desired "V" form and staggered hand placement on the golf club handle, a base center block to serve as the housing for all the other components, and a metal rod that serves as a secure golf club aligner and connector to the golf club's grip that is gripped by the person. In an illustrative example, the arm support position in relation to the base center block can be compressed through the use of the spring in the top guide roller.

The details of various embodiments are set forth in the accompanying drawings and the description below. Other features and advantages will be apparent from the description and drawings, and from the claims.

BRIEF DESCRIPTION OF DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION OF THE INVENTION

Figure 1:
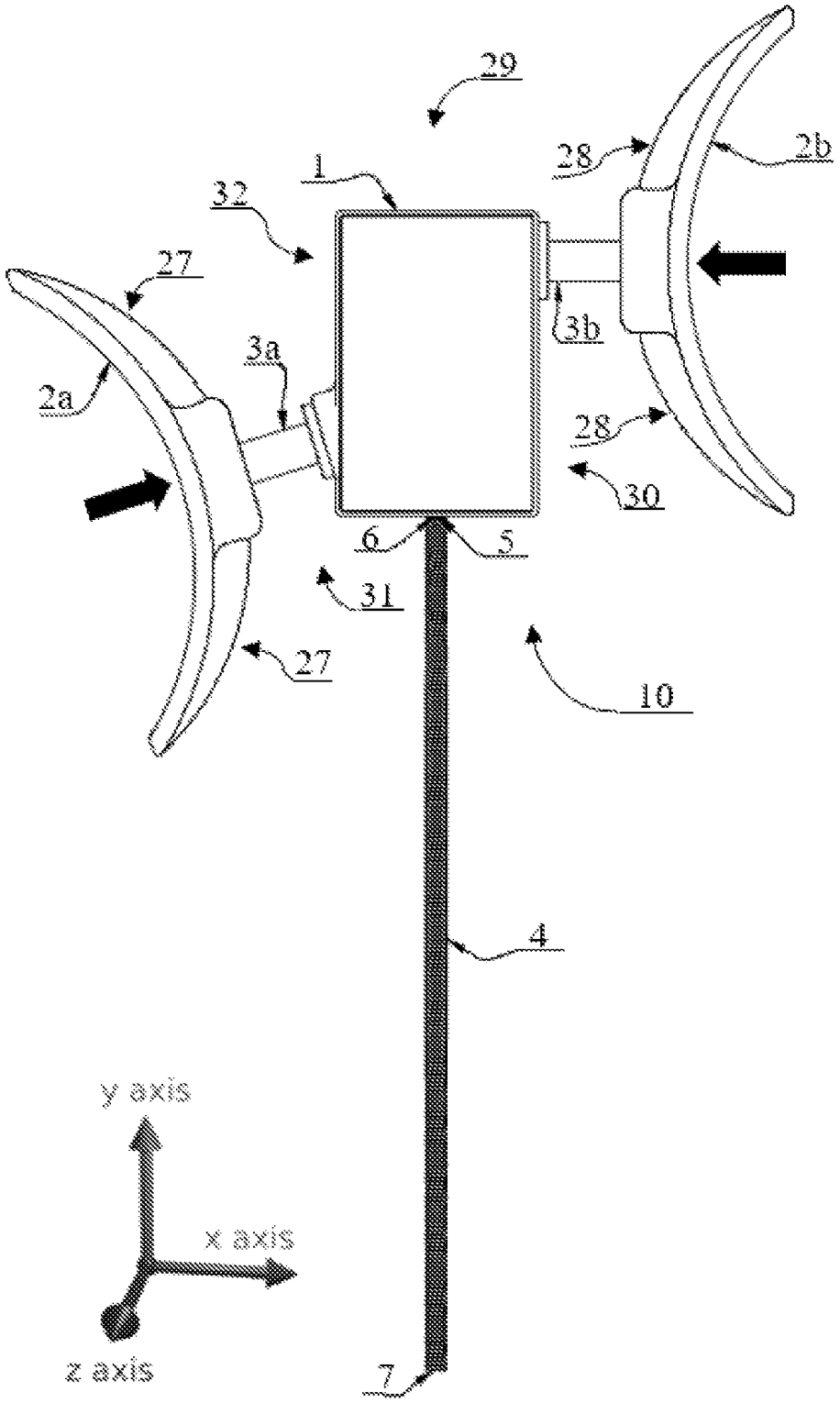
FIG. 1 is a front plan view of a golf putting swing training aid of the present disclosure that depicts the positioning and orientation.
Figure 2:
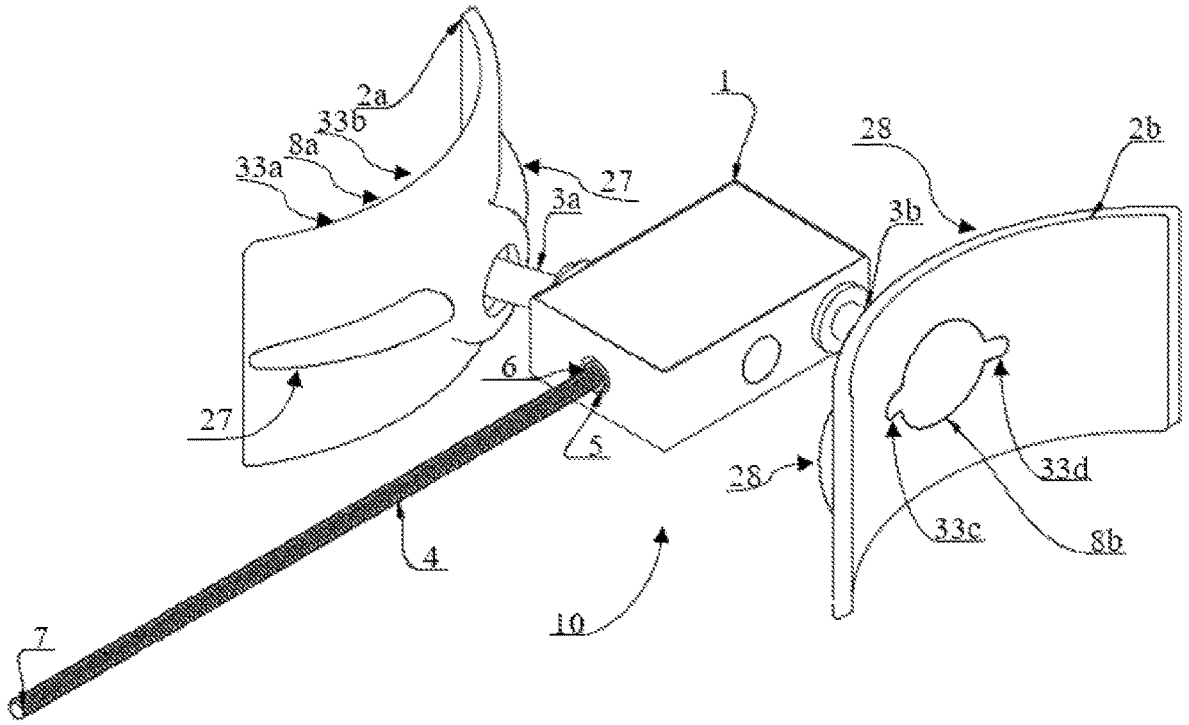
FIG. 2 is an angled plan view of a golf putting swing training aid of the present disclosure.

With reference to FIG. 1 and FIG. 2, a golf putting swing training aid of the present disclosure is shown and generally indicated at reference 10.

The top of the base center block is referred to as 29. The right side of the base center block is referred to as 30. The bottom side of the base center block is referred to as 31. The left side of the base center block is referred to as 32.

Base center block 1 serves as a housing and alignment component for all the other components. Arm supports 2*a* and 2*b* will rest on the forearms and inhibit wrist movement in favor of using the large left and right deltoid muscles and by virtue of the angle difference and spacing between the two arm supports 2*a* and 2*b* the proper hand posture on the golf club and the proper "V" form will be created. Arm support 2*a* and 2*b* additionally features a curved I-beam fin structure 27 and 28 on the back side of the component to increase rigidity and strength. Top guide roller 3*a* and 3*b* acts as a connector between the arm support 2*a* and 2*b* to the base center block 1 and by virtue of a spring, it has a compressible effect as indicated by the arrows in which the top guide roller 3*a* and 3*b* itself compresses and since top guide roller 3*a* and 3*b* serves as a connector between the arm support 2*a* and 2*b* and base center block 1, the arm support 2*a* and 2*b* also compresses. Arm support cap 8*a* and 8*b* serves to cover the top guide roller 3*a* and 3*b* from coming out of alignment with the base center block 1 and arm supports 2*a* and 2*b*; note the unique shape with the cap fin structures 33*a*, 33*b*, 33*c*, and 33*d* is to aid in the assembly process and in addition to that it prevents the top guide roller 3*a* and 3*b* from popping out of alignment when in use due to the increased surface area resulting from the use of the fins which increases friction forces which prevents the arm support cap 8*a* and 8*b* from coming undone. The alignment portion that securely aligns and connects the product to the golf putting club consists of a threaded metal rod 4 that is able to be screwed into and out of the base center block 1 through the interaction of the top surface of the rod 6 to the self-tapping threaded metal insert 5.

Having described the components and features of golf putting swing training aid 10, the method of installation will now be described.

Figure 3:
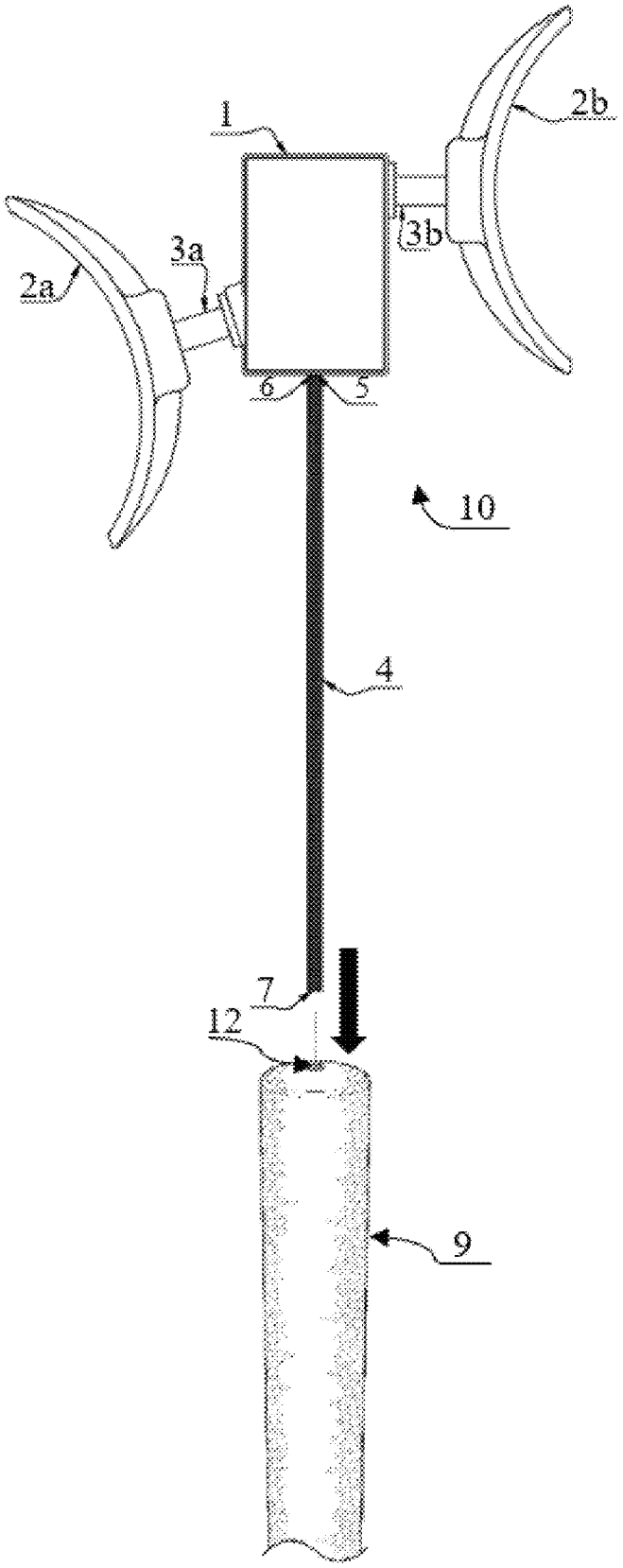
FIG. 3 is a front elevation plan view of the alignment portion of a golf putting swing training aid of the present disclosure being installed on the grip of a putting golf club.
Figure 4:
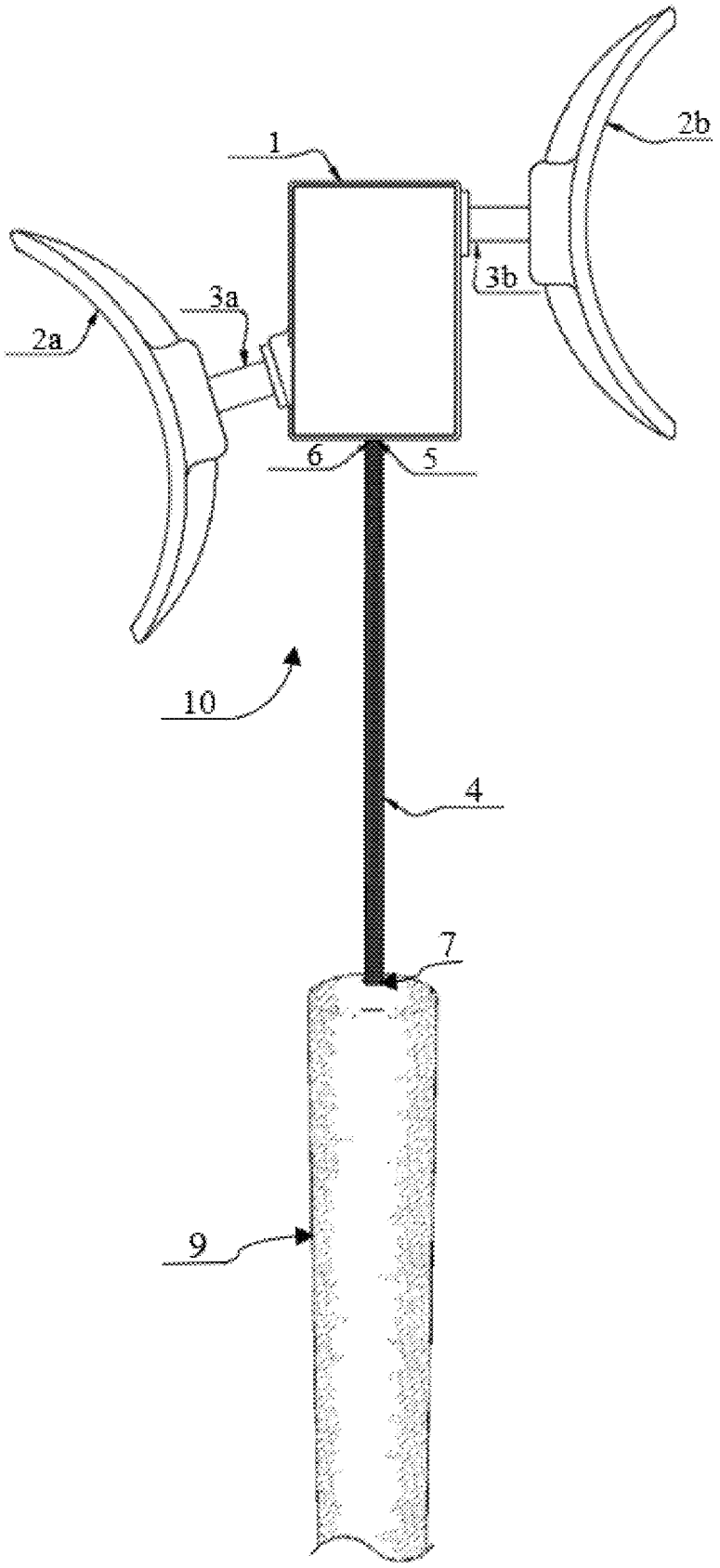
FIG. 4 is a front operational view of a golf putting swing training aid of the present disclosure installed on the grip of a putting golf club.

With reference to FIG. 3 and FIG. 4, a golf putting swing training aid of the present disclosure is shown and generally indicated at reference 10.

The alignment portion, threaded metal rod 4, of golf putting swing training aid 10 may be installed on the grip of a golf club 9 by inserting the bottom surface 7 of the threaded metal rod 4 into the grip hole 12 as indicated in FIG. 3. Proper installation is achieved when the bottom surface 7 of the threaded metal rod 4 can no longer slide in more. Such proper installation is shown in FIG. 4. Once installed, training aid 10 may be rotated clockwise or counterclockwise about the threaded metal rod 4 to align the angled arm supports to the desired position for right- or left-handed golfers or to whatever position is the most comfortable.

Having thus described the installation of golf putting swing training aid 10, a method of use and operation therefore will now be discussed.

Figure 5:
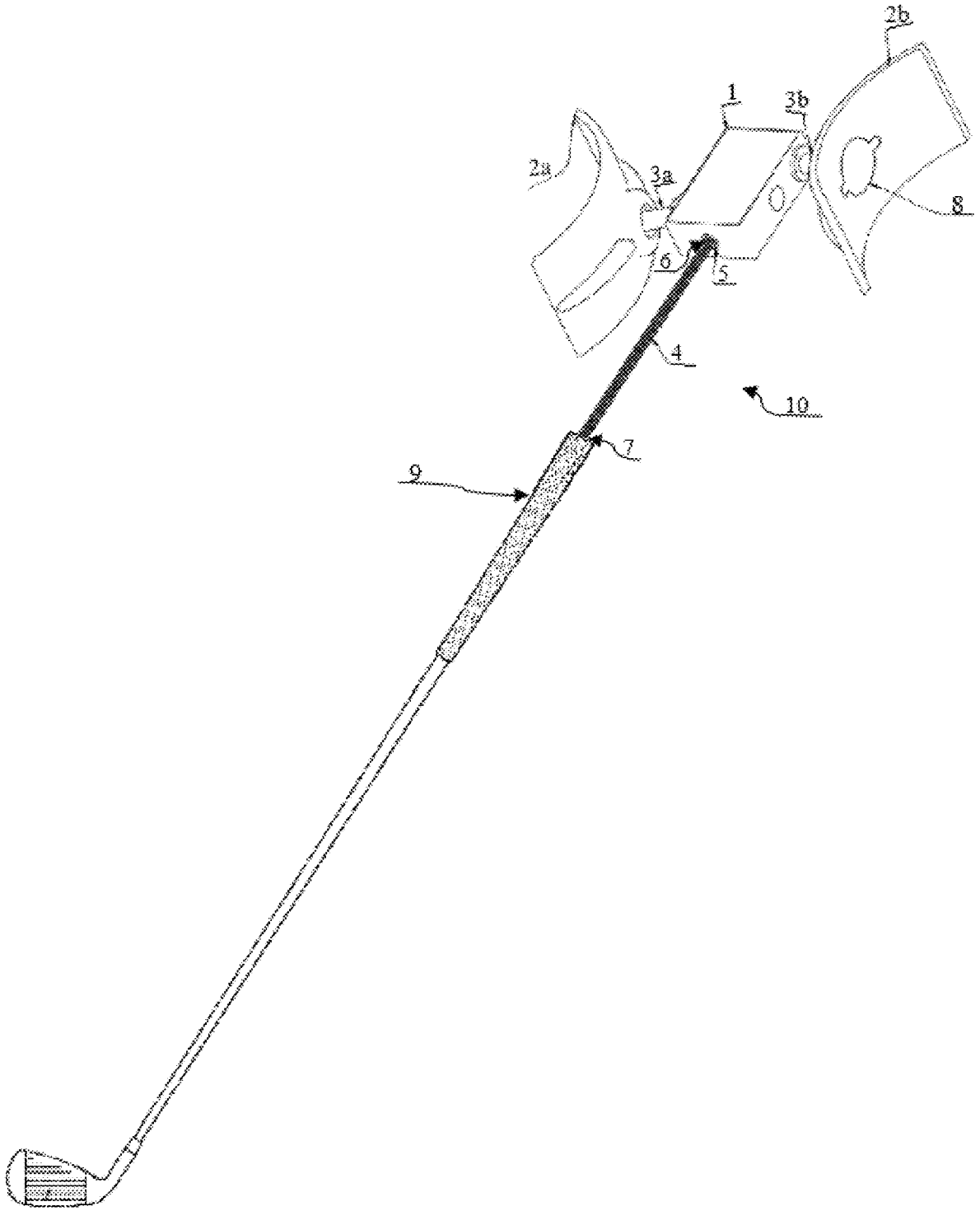
FIG. 5 is an operational side view of a golf putting swing training aid of the present disclosure installed on a putting golf club.
Figure 6:
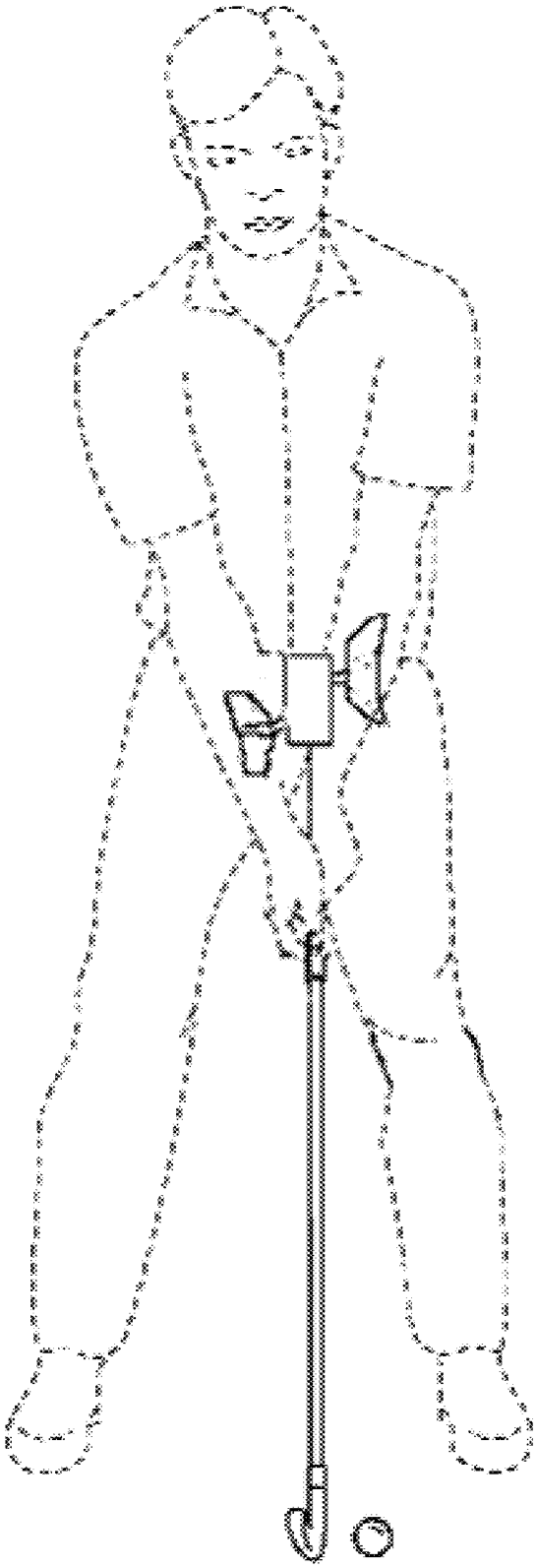
FIG. 6 is an operational front view of a golf putting swing training aid of the present disclosure installed on a putting golf club and being used by a golfer.

With reference to FIG. 5 and FIG. 6, the arm supports 2*a* and 2*b* are the only part of the aid that is physically touching the body. Through the space physically created by the product, the desired "V" shape is formed and through the one angled arm support 2*a* a staggered hand posture is formed on the grip of the golf club 9. Both effects are highly desired in the game of golf due to the higher likelihood of the golf ball being hit with more power, precision, and accuracy. As required by the different statures of each golfer, top guide roller 3*a* and 3*b* will allow each arm support 2*a* and 2*b* to compress upon a sufficient amount of force having been applied thus ensuring the most comfortable and proper fit for each and every user. The placement position and placement angle of the arm support 2*a* and 2*b* have been established based on the average position of professional golfers' arms for the varying types of putting swings and may not be perfectly situated for every particular golfer. Additionally, this placement position in which the angled arm support 2*a* and top guide roller 3*a* is located towards the bottom of the base center block 1 and the straight arm support 2*b* and top guide roller 3*b* is located near the top of the base center block 1 has been determined so as to not alter the center of gravity of the golf putting club 9 when the product is installed by too much because if this product is used as it is intended then the aid would primarily only be used during training and practicing and when on a golf course you would typically forego the aid. Additionally, the orientation of the through holes eliminates a torque force about the z-direction thus further ensuring that the aid does not alter the user's perception when using or not using the aid.

Accordingly, it will be understood and contemplated that golf putting training aid 10 may be rotated to any position about the threaded metal rod 4 to accommodate varying heights, arm lengths, and left or right-handed orientations and placement for various golfers, thus allowing it to be universally applicable regardless of age, gender, hand size, or specific hand placement of the particular golfer utilizing golf putting swing training aid 10. According to this aspect, it will be further understood that once the proper positioning is determined, golf putting swing training aid 10 may still provide a golfer with repetitive muscle training to keep the grip in the same position throughout multiple shots to train the golfer in the proper grip and hand placement to hit the desired shots and to ensure the use of the deltoid muscles in an effort to keep the golf putting club and by extension the golf ball in a straight line thus increasing accuracy, precision, and power.

Having thus described the method of use and operation of golf putting swing training aid 10, a method of assembly will now be discussed.

Figure 7:
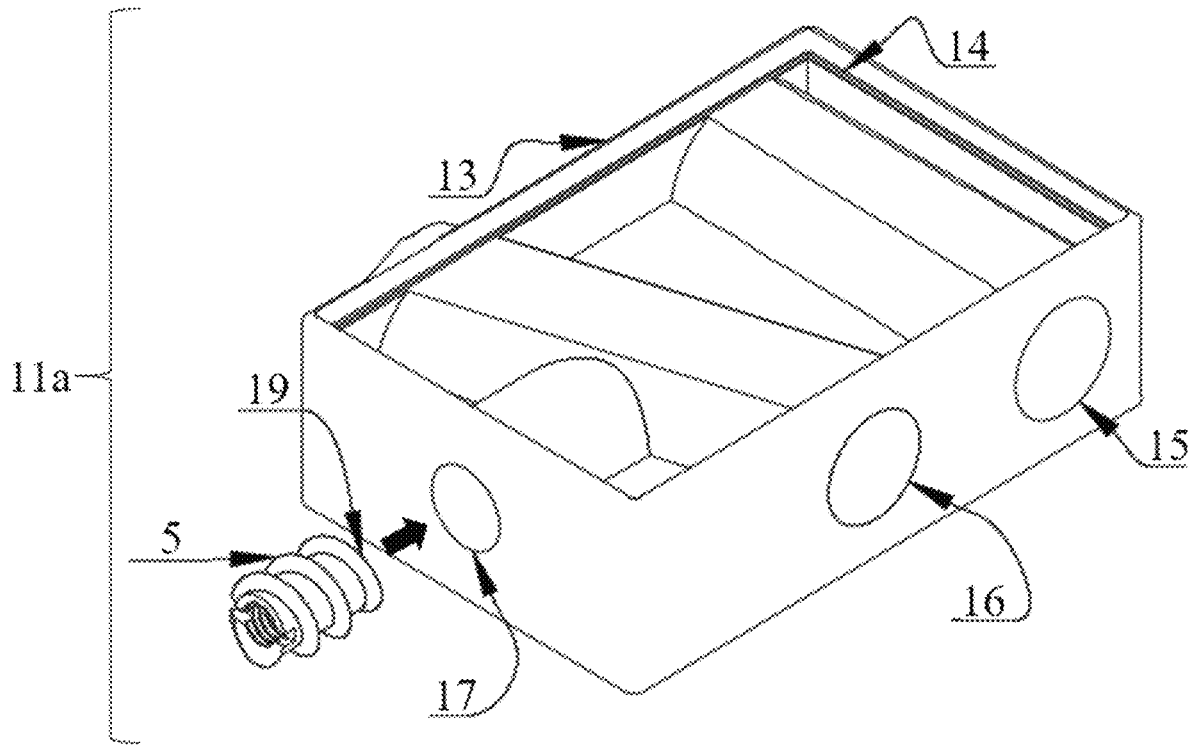
FIG. 7 is an exploded angled plan view depicting stage one of manufacturing and assembly.

With reference to FIG. 7, the skeleton center block which is a component of the golf putting swing training aid of the present disclosure is in stage one of production and is shown and generally indicated at reference 11*a*.

Figure 8:
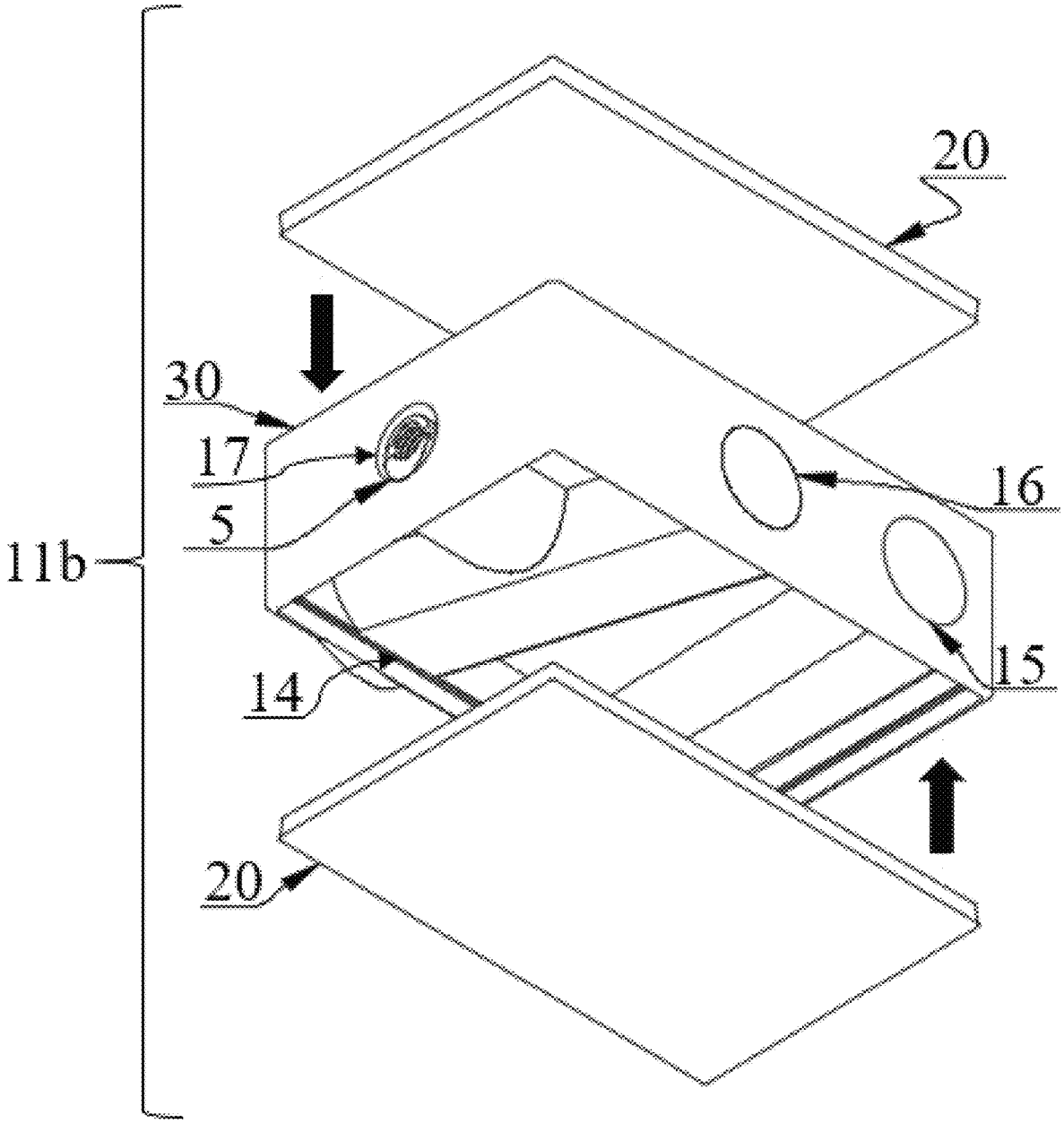
FIG. 8 is an exploded angled plan view depicting stage two of manufacturing and assembly.

Skeleton center block 13 is what houses and brings together the other components of the golf putting swing training aid. Through its two angled through holes 16 and 15 skeleton center block 13 provides a medium by which the previously discussed arm supports can be spaced out and angled to achieve the desired "V" shape of the arms and staggered hand placement on the club for the user. By making the through hole angled 16, the result is that the aforementioned arm support will as well have an angle relative to the skeleton center block 13 which will force one of the user's hands lower than the other on the golf club handle and create a "V" form thus ensuring a fundamentally sound form. Blind hole 17 is added to ensure that the threaded self-tapping metal insert 5 by way of the bottom edge 19 can be inserted and molded in place or screwed into the blind hole 17 without issue. Ultrasonic weld line 14 is a component that is needed for stage 2 of manufacturing and assembly. With reference to FIG. 8, the skeleton center block which is a component of the golf putting swing training aid of the present disclosure is in stage two of production and is shown and generally indicated at reference 11*b*.

Due to manufacturing constraints (see manufacturing description) rectangular covers 20 are used to cover both through holes 16 and 15 and blind hole 17 and make the skeleton center block 13 appear solid. The rectangular covers 20 are lowered onto the weld line 14 and then using an ultrasonic wave are welded together. Skeleton center block 30 is not fully solid because if it were solid then it would pull the center of gravity too far high away from the golf club itself. It is not desired to do that because while the user may train with the golf putting swing training aid and become accustomed to that setup but if they play a round of golf it will not be likely that they would use the golf putting swing training aid while playing in a game therefore it is imperative that the center of gravity remain as close to the real deal as possible.

Figure 9:
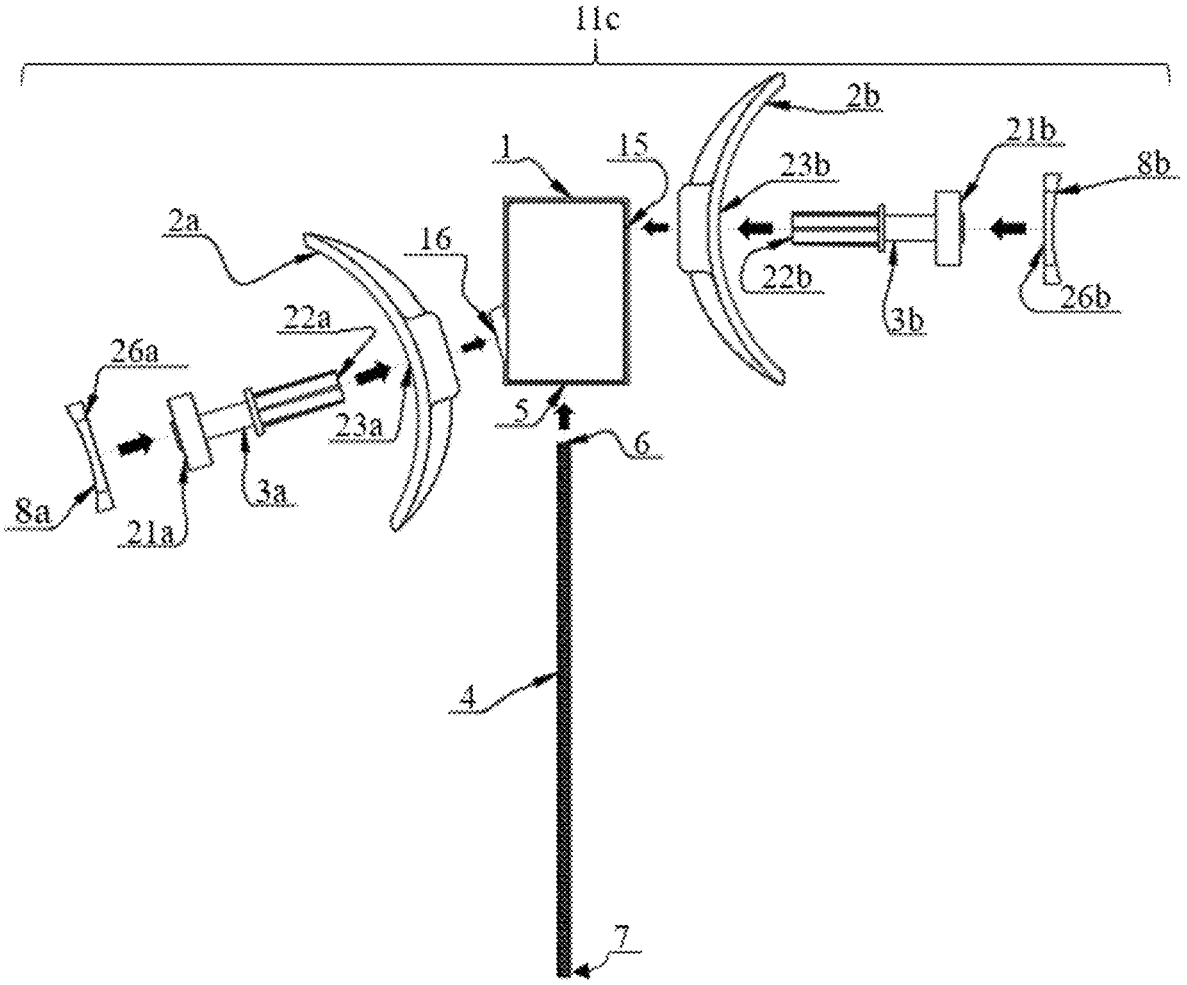
FIG. 9 is an exploded front plan view depicting stage three, the final stage, of manufacturing and assembly.

With reference to FIG. 9, a golf putting swing training aid of the present disclosure is shown and generally indicated at reference 11*c* wherein the remainder of the assembly is now depicted.

Threaded metal rod 4 which serves as a secure golf club connector to the golf club's grip is screwed from the top surface of the threaded metal rod 6 into the threaded self-tapping metal insert 5. Angled top guide roller 3*a* will from its bottom edge 22*a* go through the arm support hole 23*a* and then into the angled through hole 16 until it can longer be pushed in further. It will be held in place through the friction that results from a very low tolerance. Straight top guide roller 3*b* will from its bottom edge 22*b* go through the arm support hole 23*b* and then into the straight through hole 15 until it can no longer be pushed in further. Once both top guide rollers 3*a* and 3*b* have been put through the arm support hole 23*a* and 23*b* and then also the through hole 16 and 15 respectively then the bottom edge 26*a* and 26*b* of the arm support cap 8*a* and 8*b* is lowered onto the top surface of the top guide roller 21*a* and 21*b*. This is done as a means to ensure that the installation of the top guide roller 3*a* and 3*b* cannot come undone while in use.

Having thus described the method of assembly of golf putting swing training aid 10, a method of manufacturing will now be discussed.

With reference to FIG. 8 skeleton center block 30 (less threaded self-tapping metal insert 5), weld line 14, and rectangular covers 20 are made of acrylonitrile butadiene styrene (ABS) through the injection molding manufacturing process. The rectangular covers 20 are then lowered onto the weld line 14 and center block 30 and ultrasonically welded in place. This manufacturing technique is used because to mold the product as one big solid piece would have caused shrinkage which in turn would have caused a sink mark. The less-than-ideal shrinkage and sink mark comes from the varying thickness of the plastic walls. In a hypothetical situation in which center block 30 (less threaded self-tapping metal insert 5) would be molded into one solid piece the thickness of both the through holes to the top surface would be about 2.103 mm worth of plastic whereas at the center of the product there is 18.304 mm of solid plastic. This large difference in thickness causes uneven cooling as the thinner plastic walls will cool faster than thicker walls so while 2.103 mm worth of the 18.304 mm thick center wall will cool and contract slightly, the remaining 16.201 mm of plastic will continue to cool and contract and pull the previously cooled sections towards itself. In order to protect against this effect, the ultrasonic welding method is used. Additionally, with reference to FIG. 8. Rectangular covers 20 has a 1.5-degree draft angle. Center block 30 (less threaded self-tapping metal insert 5), has been cut in half circumference wise to add a 1.5-degree draft angle applied to both halves. With reference to FIG. 9 arm support cap's bottom edge 26*a* and 26*b* also have a draft angle of 1 degree. A draft angle is added to ensure that when the product is ejected from the mold, the surface of the product will not be damaged by the product's surface being dragged across by the surface of the mold. With this draft angle, now as the product is being ejected there will be a small 1-to-1.5-degree gap being formed between the surface of the product and the surface of the mold thus preventing damage to the surface of the product.

With reference to FIG. 9, there are multiple components with different manufacturing processes. The threaded metal rod 4 is manufactured by a third-party supplier. The top guide roller 3*a* and 3*b* is manufactured by a third-party supplier, its materials consist of metal and ABS plastic and a metal spring that allows the hardware to compress. The threaded self-tapping metal insert 5 is manufactured by a third-party supplier. The base center block 1, arm support 2*a* and 2*b* (the curved I-beam fin structure 27 and 28 is made from one piece with the arm supports 2*a* and 2*b*), and arm support cap 8*a* and 8*b* are all made from acrylonitrile butadiene styrene (ABS) and are manufactured through the injection molding process.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed:

1. A golf putting swing training aid apparatus for developing putting skills comprising: a rectangular base center block; wherein the center block has a top side, a bottom side, a right side with a through hole and a left side with a through hole; an arm support that has a curved I-beam fin structure; a guide roller; an arm support cap; wherein the arm support, the guide roller and the arm support cap are connected to the right side through hole; an arm support that has a curved I-beam fin structure; a guide roller; an arm support cap; wherein the arm support, the guide roller and the arm support cap are connected to the left side through hole; wherein the guide roller and the arm support cap are perpendicularly connected to the right side of the block; wherein the left side though hole is located at 7.5 to 27.5 degree angle in relation to the bottom surface of the block; wherein each cap has fin structures that prevent the arm supports and the guide rollers from being misaligned; a threaded metal rod that has a top end and a bottom end; a golf club comprising a grip that has a hole; wherein a metal insert is attached to the bottom side of the center block; wherein the top end of the threaded metal is attached to the metal insert and wherein the bottom end of the threaded metal is attached to the golf club grip hole.

2. The golf putting swing training aid of claim 1, wherein the threaded metal has a length that ranges from 2 inches to 15 inches.

3. The golf putting swing training aid of claim 1, wherein the threaded metal has a length is 8 inches.

* * * * *